United States Patent [19]

Oshio

[11]. Patent Number: 4,587,900

[45] Date of Patent: May 13, 1986

[54] MASTER RETAINING DEVICE FOR A PRINTING MACHINE

[75] Inventor: Susumu Oshio, Minato, Japan

[73] Assignee: Riso Kagaku Corporation, Shimbashi, Japan

[21] Appl. No.: 755,837

[22] Filed: Jul. 17, 1985

[30] Foreign Application Priority Data

Oct. 29, 1984 [JP] Japan ..... 59-227323

[51] Int. Cl.[4] ..... B41F 27/00

[52] U.S. Cl. ..... 101/382 MV

[58] Field of Search ..... 101/382 MV, 378, 415.1

[56] References Cited

U.S. PATENT DOCUMENTS 3,438,324 4/1969 Meade et al. ..... 101/382 MV 4,505,199 3/1985 Hasegawa et al. ..... 101/382 MV

OTHER PUBLICATIONS

"Magnetic Paper-Gripping Concept", Xerox Disclosure Journal, vol. 3, No. 2, Mar./Apr. 1978, p. 107.

*Primary Examiner*—E. H. Eickholt

*Attorney, Agent, or Firm*—Stevens, Davis, Miller & Mosher

[57] ABSTRACT

A printing machine includes a printing drum. A stencil master sheet retaining device for this printing machine includes: a magnet plate extending generally along a generator of the printing drum; a clamp plate, made of magnetically attractable material, which can be selectively positioned either to a position in which it lies against the magnet plate, or to a position in which it is removed away from the magnet plate; a removal strip which extends above the magnet plate generally between the magnet plate and the clamp plate; and a means for raising the removal strip away from the magnet plate, when the clamp plate is removed away from the magnet strip. This removal strip may be thin and elastic, and may be thus raised by being put into compression, optionally by its one end being fixed to the printing drum and its other end being moved towards that fixed end. In the case that the clamp plate is thus selectively positioned either against the magnet plate or away from the magnet plate by being pivoted around an axis generally parallel to the generator of the printing drum, then the removal strip, from its the fixed end, may be passed over the magnet plate and around the axis with its other end fixed to the clamp plate, the part of which generally at the axis of rotation thereof around which the removal strip is passed may be thickened.

7 Claims, 5 Drawing Figures

MASTER RETAINING DEVICE FOR A PRINTING MACHINE

BACKGROUND OF THE INVENTION

The present invention relates to a device to be included in a printing machine for retaining a master stencil sheet, and more particularly relates to a device for attaching and retaining the leading edge of a stencil master sheet along a generator of a printing drum incorporated in a printing machine.

Various currently known types of printing machine incorporate a printing drum device around which a stencil master sheet is wrapped for performing the printing process; typically, in the use of such a printing machine, ink for printing is supplied from the inside of the printing drum via a large number of small holes in its outer surface to the inner side of the stencil master sheet wrapped therearound, and passes (only) through the perforated portions of said stencil master sheet to the outer side of said sheet, so as to be imprinted on a printing sheet such as a paper sheet and so as to duplicate the pattern perforated on said stencil master sheet. In such a printing machine, a device is required for securing one edge, typically the leading edge, of the stencil master sheet to the printing drum, typically along one of the generators thereof, in order securely to fix said stencil master sheet to the printing drum during the stencil printing process; and this securing or retaining device is required selectively to be actuatable to thus fix the edge of the master sheet to the printing drum, or to be actuatable to release said edge of said master sheet. Various such stencil master retaining devices have been proposed, and in particular the assignee company of the present patent application has proposed, in Japanese Patent Applications Ser. Nos. Sho 57-21845 (1982) and Sho 57-207217 (1982), a clamp type stencil master sheet retaining device, in which a magnet plate is fitted generally along a generator of the printing drum, and a movable clamp plate is selectively either held away from said magnet plate or is allowed to be attracted against said magnet plate by the magnetic force thereof. Thus, when it is desired to retain the leading edge of a stencil master sheet along said generator of said printing drum, then said leading edge is placed over the magnet plate, and the clamp plate is allowed to be attracted against said magnet plate while pinching said leading edge therebetween and thus retaining said stencil master sheet; but, when it is desired to release said stencil master sheet, then said clamp plate is held away from said magnet plate, thus letting go of said leading edge of said stencil master sheet.

This type of stencil master retaining device is very adequate for use in the case that the leading edge of the stencil master is thickened and reinforced by a retainer reinforcement strip; however, in the case that the stencil master sheet is thin and is of the so called headless type in which its leading edge is not particularly differentiated from its main body and is not thickened or reinforced (and this is a type particularly suited to automatic operation, since such stencil master sheets can be cut successively from a long roll of stencil master), then the difficulty can arise that, when the clamp plate is raised away from the magnet plate to release the leading edge of said stencil master, said leading edge does not properly become separated from said magnet plate against which it was clamped, but remains attached thereto (and thereby to said printing drum) by the effect of static electricity or the like. In this event, the subsequent operation of removal of the stencil master sheet from the printing drum becomes difficult and may not be successful. Particularly when the removal and disposal of the stencil master sheet is being performed by an automatic device, such for example as those disclosed in Japanese Utility Model Applications Serial Nos. Sho 54-17959 (1979), Sho 56-97030 (1981), or Sho 57-63378 (1982), then there is a great danger of the occurrence of an ejection failure with the printing master not being properly peeled away from the printing drum. In particular, a printing master sheet such as the type used in the thermal perforation method which is extremely thin and has a very smooth surface will particularly tend to adhere to the surface of the magnet plate, and will be particularly prone to ejection failure.

SUMMARY OF THE INVENTION

Accordingly, it is the primary object of the present invention to provide a stencil master retaining device for a drum type printing machine, which avoids the above outlined problems.

It is a further object of the present invention to provide such a stencil master retaining device, which ensures that the leading edge of the stencil master sheet does not undesirably adhere to the magnet plate, when it should have been released therefrom.

It is a further object of the present invention to provide such a stencil master retaining device, which positively and definitely releases the leading edge of the stencil master sheet from the magnet plate.

It is a further object of the present invention to provide such a stencil master retaining device, which ensures that the ejection and removal process for a used stencil master sheet is sure and effective.

It is a further object of the present invention to provide such a stencil master retaining device, which incorporates a means for positively and definitely removing the leading edge of the stencil master sheet away from the magnet plate. It is a further object of the present invention to provide such a stencil master retaining device, which definitely annuls the undesirable effects of static electricity.

It is a yet further object of the present invention to provide such a stencil master retaining device, which is well adapted to the use of stencil master sheets which are cut from a long roll of stencil master material.

It is a yet further object of the present invention to provide such a stencil master retaining device, which is well adapted to the use of stencil master sheet such as used in the thermal perforation method.

According to the present invention, these and other objects are accomplished by, for a printing machine comprising a printing drum: a stencil master sheet retaining device, comprising: a magnet plate extending generally along a generator of said printing drum; a clamp plate, made of magnetically attractable material, which can be selectively positioned either to a position in which it lies against said magnet plate, or to a position in which it is removed away from said magnet plate; a removal strip which extends above said magnet plate generally between said magnet plate and said clamp plate; and a means for raising said removal strip away from said magnet plate, when said clamp plate is removed away from said magnet strip.

According to such a structure, when the leading edge of a stencil master sheet is laid on the magnet plate over the removal strip, and the clamp plate is then positioned to lie against said magnet plate with said leading edge of said stencil master sheet and said removal strip lying therebetween, then said leading edge of said stencil master sheet will be well and effectively fixed along said generator of said printing drum, and the stencil printing process can be performed. On the other hand, when it is desired to release the stencil master sheet from this engagement to the printing drum, then the clamp plate is positioned to be removed away from the magnet plate, and this causes the removal strip to be raised away from said magnet plate by the means for doing so, which positively and effectively lifts said leading edge of said stencil master sheet away from the magnet plate, thus breaking any undesirable residual engagement which might be otherwise provided between said leading edge and said magnet plate due to the action of static electricity or the like. This ensures that the subsequent operation of removing and ejecting the stencil master sheet from the printing machine will be successful and will not be subverted by unplanned and undesirable adhesion of the stencil master sheet to the magnet plate. Accordingly, this retaining device is well suited to use in an automatic type of stencil printing machine, and in one in which the stencil master used is thin and smooth, such as one in which said stencil master is made from thermally perforable stencil master material and is thermally perforated. And, further, this positive removal of the leading edge of the stencil master sheet away from its retained position along said generator of the printing drum by the removal strip does not involve any thickening requirement for said leading edge of said stencil master sheet, and thus the present invention is suitable for application to a stencil printing machine in which the stencil master sheet is of the so called headless type in which its leading edge is not particularly differentiated from its main body and is not thickened or reinforced, such as the type of stencil master sheet which is cut successively from a long roll of stencil master.

Further, according to various more specialized aspects of the present invention, one end of said removal strip may be fixed with relation to said printing drum, and said removal strip, when said clamp strip is removed away from said magnet strip, may be raised away from said magnet strip by being put into compression. Further, said removal strip, when said clamp strip is removed away from said magnet strip, may be raised away from said magnet strip by being put into compression by its other end, which constitutes said raising means, being moved in the direction towards its said fixed end. Yet further, in the event that said clamp plate is thus selectively positioned, either against said magnet plate or away from said magnet plate, by being pivoted around an axis generally parallel to said generator of said printing drum, then said removal strip, from its said fixed end, may be passed over said magnet plate and around said axis, and its said other end may be fixed to said clamp plate. In this case, the part of said clamp plate generally at said axis of rotation thereof, around which said removal strip is passed, may be thickened, and, when said clamp plate is positioned to lie against said magnet strip, said removal strip may be pulled tight and held against said magnet strip between said clamp plate and said magnet strip. All of these constructional possibilities are useful specializations of the present invention.

BRIEF DESCRIPTION OF THE DRAWINGS

The present invention will now be described in terms of the preferred embodiment thereof, and with reference to the appended drawings. However, it should be understood that the description of the embodiment, and the drawings, are not any of them intended to be limitative of the scope of the present invention, since this scope is to be understood as to be defined by the appended claims, in their legitimate and proper interpretation. In the drawings, like reference symbols denote like parts and dimensions and so on in the separate figures thereof; spatial terms are to be understood as referring only to the orientation on the drawing paper of the relevant figure and not to any actual orientation of an embodiment, unless otherwise qualified; and:

DESCRIPTION OF THE PREFERRED EMBODIMENT

Figure 1:
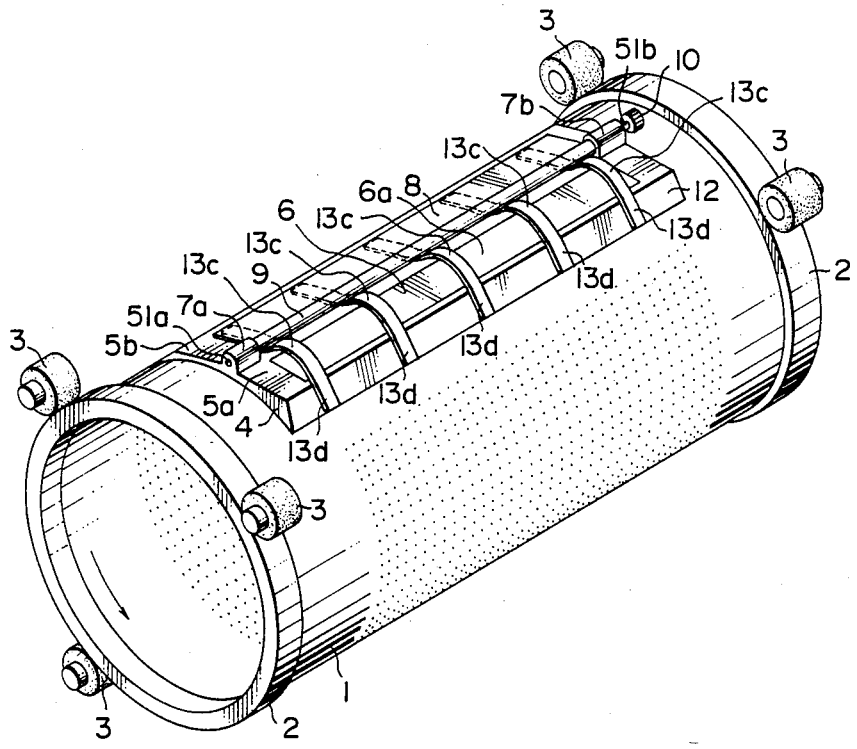
FIG. 1 is a perspective view of essential portions of a drum type printing machine which incorporates the preferred embodiment of the master retaining device of the present invention.

The present invention will now be described in detail with respect to the preferred embodiment thereof, and with reference to the drawings. FIG. 1 is a perspective view of relevant portions of a drum type printing machine incorporating this preferred embodiment, and FIGS. 2 through 5 are transverse sectional views therethrough, showing said preferred embodiment in various different operational states. In these figures, the reference numeral 1 denotes a cylindrical printing drum of a rotary stencil printing machine, and this printing drum 1 is supported, so as to be rotatable around its longitudinal axis with respect to a frame not shown of the printing machine, by three rollers 3 provided at each end of said drum 1, which support said end of said drum 1 via an annular guide and support ring 2 formed on each said end of said drum 1. The drum 1 is formed as a hollow cylinder and has a large plurality of small holes formed through it for conducting printing ink during the printing process from its inner surface to its outer surface, but since this matter is not directly relevant to the present invention it will not be further discussed herein.

A master retaining mount 4 formed as a platform is mounted on the outer surface of the printing drum 1 and extends generally parallel to the generators of said drum 1. The shape of this retaining mount 4 can be best seen in the sectional views thereof presented in FIGS. 2 through 5: it has an upper surface 5 which is generally formed as two plane surfaces 5*a* and 5*b* which would meet in a line parallel to the generators of the printing drum 1 and which are angled at an obtuse angle to one another, and also has a particular sloping face 12 joining between the plane surface 5*a* and the outer surface of the drum 1; this particular sloping face 12 is the trailing sloping face of the retaining mount 4 with respect to the preferential direction of rotation of the printing drum 1, which is indicated by an arrow in the figures. Along the line where (otherwise) the plane surfaces 5*a* and 5*b* would meet, the upper surface of the mount 4 is scooped out in the form of a generally cylindrical trough 50 which extends parallel to the generators of the printing drum 1 substantially from one end to the other of said drum 1. At opposite ends of this trough 50 are provided bearing lugs 7*a* and 7*b* with mounting holes formed through them whose common axis is substantially coincidental with the central axis of the cylindrical trough 50, and, as shown in the drawings although it is not absolutely necessary for the present invention, the side edges of the trough 50 are rounded off to make them smooth, and in particular the side edge of said trough 50 on the side thereof towards the abovementioned sloping face 12 is so rounded off, as shown by the reference numeral 60 in the figures.

Embeddingly inlaid into the planar upper surface 5*a* of the retaining mount 4 on the trailing side of the trough 50 there is provided a strip shaped magnet plate 6, which extends in the direction of the generators of the printing drum 1 substantially entirely along the longitudinal direction of the retaining mount 4, from one end to the other of the printing drum 1, and the upper surface 6*a* of this magnet plate 6 is coplanar with this upper plane surface 5*a* of the mount 4. This magnet plate 6 is a permanent magnet, such as a multipole magnet, and is formed of a material of suitable frictional and resilient characteristics, such as rubber magnetic material. Similarly, embeddingly inlaid into the planar upper surface 5*b* of the retaining mount 4 on the leading side of the trough 50 there is provided another strip shaped magnet plate 11, which also extends in the direction of the generators of the printing drum 1, and the upper surface 11*a* of this magnet plate 11 is similarly coplanar with this upper plane surface 5*b* of the mount 4. This magnet plate 11 also is a permanent magnet such as a multipole magnet, and may be similarly formed of a material with the frictional and resilient characteristics of material such as rubber magnetic material, although this is not essential.

Figure 2:
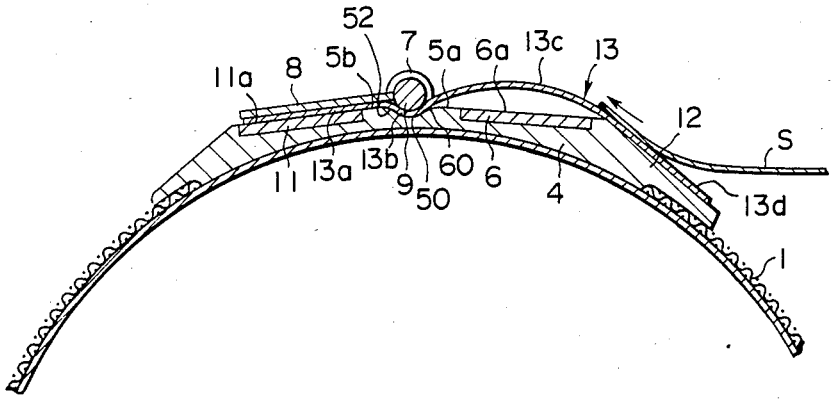
FIG. 2 is a transverse sectional view of the drum of said printing machine and of said preferred embodiment master retaining device, showing the leading edge of a stencil master just being started to be fed onto a mount of said retaining device for being gripped by a clamp plate and retained.

A clamp plate 8 is formed as a long strip member and is made of a magnetically attractable material such as steel. Along a long edge of this clamp plate 8 there is integrally formed a substantially cylindrical and quite thin roller member 9, with the clamp plate 8 extending substantially radially outwards from this roller member 9, joining to it along one of its generators. From the opposite ends of this roller member 9 there extend mounting axle members 51*a* and 51*b* (see FIG. 1), and the somewhat shorter one 51*a* of these axle members is fitted into the mounting hole of the lug 7*a*, while the other axle member 51*b* which is the somewhat longer one thereof is fitted through the mounting hole of the other lug 7*b* and has a drive pinion 10 fixedly mounted on its end. Thus, the clamp plate 8 and the integral roller member 9 are rotatably supported parallel to the generators of the printing drum 1 by the lugs 7*a* and 7*b*, with the roller member 9 held partly within and substantially coaxial with the trough 50, and with a certain gap, designated in the figures as 52, being left between the outer surface of the roller member 9 and the inner surface of the trough 50. This gap 52 is sufficiently wide (in its extent in the radial direction of the trough 50) for a plurality of elastic strips 13 which will be discussed below to fit through it, between the outer surface of the roller member 9 and the inner surface of the trough 50. Thus, by being rotatably supported as explained above, the clamp plate 8 and the integrally formed roller member 9 can be selectively rotated, by turning and positioning the drive pinion 10 appropriately, either: to its fullest extent in the clockwise direction as seen in the figures to a clamp position as shown in FIG. 4 in which said clamp plate 8 rests and is pressed against the trailing magnet plate 6 (with the interposition of certain membranous elements therebetween as will be explained later) and is attracted by said magnet plate 6 and is thereby held in this clamp position; or to its fullest extent in the anticlockwise direction as seen in the figures to a release position as shown in FIGS. 1 and 2, slightly more than 180 degrees from the above described clamp position, in which said clamp plate 8 is pressed against the leading magnet plate 11 and is attracted by said magnet plate 11 and thereby is held in this release position; or to any of various intermediate positions between said clamp position and said release position, as exemplarily shown in FIGS. 3 and 5. The means provided for thus rotationally driving the clamp plate 8 and the roller member 9 by turning the drive pinion 10 includes a drive gear wheel which selectively meshes with the drive pinion 10 and various drive and control means, and is not shown in the present figures and will not be further discussed herein with regard to its structure but only with regard to the functions which it performs; if detail is required as to the structure of this drive means for the clamp plate 8 and so on, reference should be made to Japanese Patent Application Serial No. Sho. 57-207217 (1982), which has been published as Japanese Patent Publication Serial No. Sho. 59-96984 (1984).

At positions spaced apart in the longitudinal direction along the inclined face 12 of the retaining mount 4 there are fixed thereto by adhesive or the like the one ends 13*d* of a plurality (five in the shown preferred embodiment) of thin flexible strips 13 which are made of sheet material, as best seen in FIG. 1; only one of these strips 13 can be seen in the sectional views of FIGS. 2 through 5, because only this one of these strips 13 is sectioned by the plane of these figures. The material for these thin strips 13 may exemplarily be polyester sheet with a thickness of 0.05 mm to 0.5 mm, or carbon fiber sheet. Each of these strips 13 is fixed as extending in the direction peripheral to the printing drum 1, i.e. perpendicular to the generators thereof, and is extended, as shown in FIGS. 2 through 5, with its main portion 13*c* which extends from said end 13*d* passing across the surface 6*a* of the magnet plate 6 and the coplanar surface 5*a* of the retaining mount 4 and reaching into the gap 52 defined as explained above between the outer surface of the roller member 9 and the inner surface of the trough 50, with its winding portion 13*b* which extends from said main portion 13*c* passing through this gap 52 round the roller member 9, and with its fixing end portion 13*a* which extends from said winding portion 13*b* laid against the surface of the clamp plate 8 in the anticlockwise direction as seen in the figures, to which surface said fixing end portion 13*a* is secured again by adhesive or the like. The length of each of these flexible strips 13 is so arranged that, when the clamp plate 8 and the integral roller member 9 are rotated by turning the drive pinion 10 to the fullest extent in the clockwise direction as seen in the figures to their clamp position as explained above and as shown in FIG. 4 in which the clamp plate 8 is pressed against the trailing magnet plate 6 (with the interposition therebetween of certain membranous elements as will be explained later) and is attracted by said magnet plate 6 and thereby held in this clamp position, then said thin strip 13 is stretched substantially tight between its end portions 13*a* and 13*d*, so that its main portion 13*c* is pulled straight and tightly against the surface 6*a* of the magnet plate 6 and the coplanar surface 5*a* of the retaining mount 4. On the other hand, when the clamp plate 8 and the integral roller member 9 are rotated by turning the drive pinion 10 to the fullest extent in the anticlockwise direction as seen in the figures to their release position as explained above and as shown in FIGS. 1 and 2 in which the clamp plate 8 is pressed against the leading magnet plate 11 and is attracted by said magnet plate 11 and thereby held in this clamp position, then said thin strip 13 is not stretched tight between its end portions 13*a* and 13*d*, but has a certain amount of slack forced into its extension by being placed into compression, so that its main portion 13*c* arches upwards and away from the surface 6*a* of the magnet plate 6 and from the coplanar surface 5*a* of the retaining mount 4.

Now, with reference to the sectional views shown in FIGS. 2 through 5, the operation of the shown preferred embodiment of the present invention will be explained in detail.

In FIG. 2, there is shown the beginning stage of the attachment of a sheet S of flexible master material to the outer surface of the printing drum 1. At this time, the clamp plate 8 and the integral roller member 9 are positioned by turning of the drive pinion 10 to the fullest extent in the anticlockwise direction as seen in the figures to their release position as explained above in which the clamp plate 8 is pressed against the leading magnet plate 11 and is attracted by said magnet plate 11 and thereby held in this clamp position, and the thin strip 13 has a certain amount of slack in its extension, so that its main portion 13*c* arches upwards and away from the surface 6*a* of the magnet plate 6 and from the coplanar surface 5*a* of the retaining mount 4. In this condition, the leading edge of a sheet S of master sheet material is fed (by a feeding means, not shown in the figures, which will not be discussed herein with regard to its structure but only with regardf to its function) in the leftwards direction in the figure, so as to be approached to and to be brought above the upper surface 6*a* of the trailing magnet plate 6, with the interposition therebetween of the main portions 13*c* of the flexible strips 13, over which said leading edge of the sheet S of master material slides and on which it rests.

Figure 3:
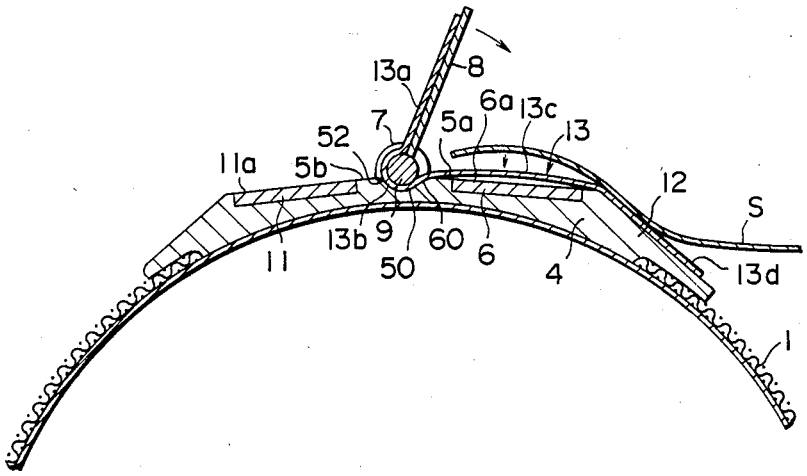
FIG. 3 is a section similar to that of FIG. 2, showing said leading edge of said stencil master in the position of having been fully fed onto said mount and being about to be clamped by said clamp plate.
Figure 4:
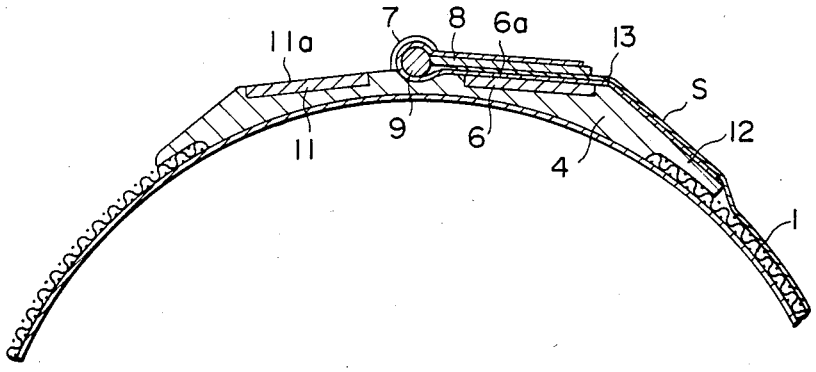
FIG. 4 is another section similar to those of FIGS. 2 and 3, showing the apparatus in its operational condition of gripping said leading edge of said stencil master by said clamp plate.

When this position of the master sheet S is attained, then the feeding of said master sheet S by the aforesaid feeding means is stopped, and next by the aforesaid driving means (not shown) the clamp plate 8 and the integral roller member 9 are rotated by turning the drive pinion 10 in the clockwise direction as seen in the figures towards their clamp position as explained above, and as this is done (an intermediate stage in this process is shown in FIG. 3) the arching of the main portions 13*c* of the flexible strips 13 is gradually and steadily reduced, by the taking up of the slack in said flexible strips 13 by the tightening of said flexible strips 13 caused by the winding of their winding portions 13*b* around the periphery of the thin roller member 9, due to the pulling on the end portions 13*a* of said flexible strips 13 by their fixing to the clamp plate 8. And at this time the leading edge of the master is allowed to sink down towards the upper surface 6*a* of the magnet plate 6, as this arching of the main portions 13*c* of the strips 13 diminishes.

Now, when this clockwise rotation of the clamp plate 8 and the integral roller member 9 has been fully executed, so that the apparatus has come to its position as shown in FIG. 4 in which the clamp plate 8 is pressed against the trailing magnet plate 6 with the interposition therebetween of the flexible strips 13 and of the leading edge portion of the master sheet S, and is attracted by said magnet plate 6 and thereby held in this clamp position so as to clamp said leading edge portion of said master sheet S against the upper surface 6*a* of said magnetic plate 6, then at this time the thin strips 13 are stretched substantially tight between their end portions 13*a* and 13*d*, so that their main portions 13*c* are pulled straight and tightly against the surface 6*a* of the magnet plate 6 and the coplanar surface 5*a* of the retaining mount 4, thus not offering any substantial opposition to the good clamping of the leading edge of the master sheet S as explained above.

When the leading edge of the master sheet S has been thus clamped and retained, then the printing drum 1 is rotated in the anticlockwise direction as seen in the figures, so as to wrap the master sheet S around said printing drum 1, in preparation for stencil printing; this process, and the stencil printing process which follows thereupon, will not be particularly described herein, and are not shown by any figures, because they are not directly relevant to the present invention.

Figure 5:
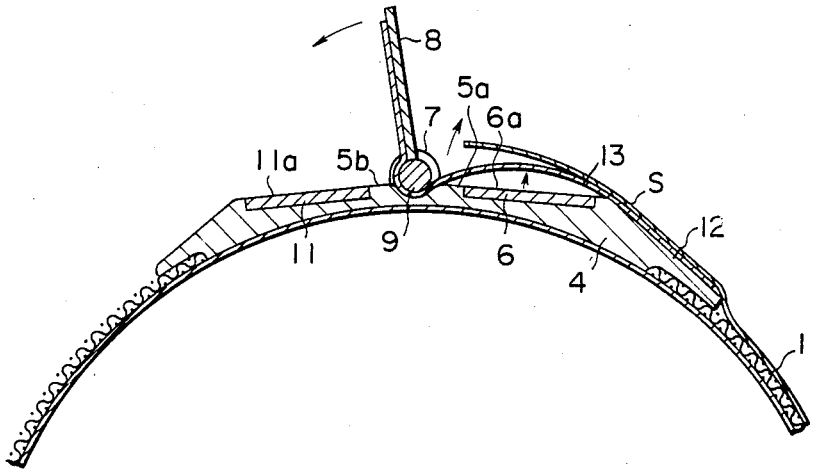
FIG. 5 is another section similar to those of FIGS. 2 through 4, showing the apparatus in its operational condition, having released said leading edge of said stencil master from its gripped condition by said clamp plate of forcibly raising said leading edge away from the top surface of said mount by the arching of certain thin flexible strip members.

When this stencil printing process has been completed, according to the operation of this type of stencil printing device it is required to unwind the used stencil master sheet S (which has presumably become filthy with printing ink, and is now to be discarded) from the printing drum 1, and as a preliminary this unwinding naturally requires the releasing of the leading edge of said stencil master sheet S from its clamping as explained above provided by the clamp plate 8 against the upper surface 6*a* of the magnet plate 6. At this time, therefore, the clamp plate 8 and the integral roller member 9 are started to be driven, by turning of the drive pinion 10, around in the anticlockwise direction as seen in the figures towards their release position as explained above and as shown in FIG. 2, in which the clamp plate 8 is again pressed against the leading magnet plate 11 and is attracted by said magnet plate 11 and thereby is held in this release position. Shortly after the starting of this releasing driving process for the clamp plate 8, the clamping of the leading edge of the stencil master sheet S is of course released, by the snapping away of the clamp plate 8 from the magnet plate 6. Next, as this driving process of rotating the clamp plate 8 continues, (an intermediate stage in the process is shown in FIG. 5), due to the steady and progressive introduction of a certain amount of slack in the extension of the flexible strips 13 by the pushing of their ends 13*a* by the rotation of the clamp plate 8 and due to the unwinding of their winding portions 13*b* from around the thin roller member 9, their main portions 13*c* steadily and progressively more and more are fored to become arched upwards and away from the surface 6a of the magnet plate 6 and away from the coplanar surface 5a of the retaining mount 4, thus forcibly lifting the leading edge of the sheet S of master sheet material away from the upper surface 6a of the trailing magnet plate 6, as shown by the arrow in FIG. 5, thereby well and positively detaching said leading edge from its adhesion to said upper surface 6a, even against such resistance to such peeling away as may possibly be caused by static electricity or by other possible causes, as explained previously in this specification. Thus, the leading edge of the stencil master sheet S is brought to a position in which it is lifted up away from the surface 6a of the magnet plate 6 and away from the coplanar surface 5a of the retaining mount 4, whereby it is well prepared for the next stage in the operation of this printing machine (not particularly described herein) in which the printing drum 1 is rotated in the clockwise rotational direction and the stencil master sheet S as a whole is peeled away from said printing drum 1 and is detached, compressed, and discarded.

Now, an important but not essential feature of the shown preferred embodiment of the present invention is the rounding off (shown by 60) of the side edge of the trough 50 on the side thereof towards the sloping face 12 of the mount 4, because this ensures that scratching and frictional damage on the strips 13 of flexible material is minimized, as they are pulled to and fro through the gap 52. This is a useful specialization of the present invention.

The provision of the thin flexible strips 13 as a plurality of strips, although considered to be preferable for the present invention, is not essential thereto. In fact, in an alternative possible embodiment, there could be provided only one flexible strip 13, which should extend along a substantial portion of the longitudinal length of the trailing magnet plate 6, for proper efficacity. Other possible modifications of the present invention could be conceived of. Therefore, although the present invention has been shown and described in terms of the preferred embodiment thereof, and with reference to the appended drawings, it should not be considered as being limited thereby, since many possible variations on the shown preferred embodiment are possible, without departing from the scope of the present invention; and likewise the presently appended drawings may contain various features which are not essential to the gist of the present invention. Accordingly, the scope of the present invention, and the protection desired to be accorded by Letters Patent, are not to be defined by any of the details of the terms of the above description, or by any particular features of the hereto appended drawings, but solely by the legitimate and proper scope of the accompanying claims, which follow.

What is claimed is:

1. For a printing machine comprising a printing drum:

a stencil master sheet retaining device, comprising:

a magnet plate extending generally along a generator of said printing drum;

a clamp plate, made of magnetically attractable material, which can be selectively positioned either to a position in which it lies against said magnet plate, or to a position in which it is removed away from said magnet plate;

a removal strip which extends above said magnet plate generally between said magnet plate and said clamp plate; and a means for raising said removal strip away from said magnet plate, when said clamp plate is removed away from said magnet strip.

2. A stencil master retaining device according to claim 1, wherein said removal strip is a thin elastic strip.

3. A stencil master retaining device according to claim 2, wherein one end of said removal strip is fixed with relation to said printing drum, and wherein said removal strip, when said clamp strip is removed away from said magnet strip, is raised away from said magnet strip by being put into compression.

4. A stencil master retaining device according to claim 3, wherein said removal strip, when said clamp strip is removed away from said magnet strip, is raised away from said magnet strip by being put into compression by its other end, which constitutes said raising means, being moved in the direction of its said fixed end.

5. A stencil master retaining device according to claim 4, said clamp plate being thus selectively positioned, either against said magnet plate or away from said magnet plate, by being pivoted around an axis generally parallel to said generator of said printing drum; wherein said removal strip, from its said fixed end, is passed over said magnet plate and around said axis, and its said other end is fixed to said clamp plate.

6. A stencil master retaining device according to claim 5, wherein the part of said clamp plate generally at said axis of rotation thereof, around which said removal strip is passed, is thickened.

7. A stencil master retaining device according to claim 6, wherein, when said clamp plate is positioned to lie against said magnet strip, said removal strip is pulled tight and is held against said magnet strip between said clamp plate and said magnet strip.

* * * * *